US006119414A

United States Patent [19]

Okayasu

[11] Patent Number: 6,119,414

[45] Date of Patent: Sep. 19, 2000

[54] ROCKET DAMPING DEVICE

[76] Inventor: Kenji Okayasu, No. 305, 1-3-1, Minami-Azabu, Minato-ku, Tokyo, Japan

[21] Appl. No.: 08/684,079

[22] Filed: Jul. 19, 1996

[30] Foreign Application Priority Data

Jul. 21, 1995 [JP] Japan ..... 7-185591

[51] Int. Cl.[7] ..... E04H 9/02

[52] U.S. Cl. ..... 52/167.2; 52/1; 52/167.1

[58] Field of Search ..... 52/1, 167.1, 167.2

[56] References Cited

U.S. PATENT DOCUMENTS

| | | | |
|---|---|---|---|
| 4,429,496 | 2/1984 | Masri | 52/1 |
| 4,924,640 | 5/1990 | Suizu et al. | 52/167.2 |
| 5,036,633 | 8/1991 | Kobori et al. | 52/167.2 X |
| 5,311,709 | 5/1994 | Kobori et al. | 52/167.2 |
| 5,544,452 | 8/1996 | Fujita et al. | 52/167.2 |

FOREIGN PATENT DOCUMENTS

| | | | |
|---|---|---|---|
| 2-266071 | 10/1990 | Japan | 52/167.2 |

*Primary Examiner*—Carl D. Friedman
*Assistant Examiner*—Kevin D. Wilkens
*Attorney, Agent, or Firm*—Pillsbury Madison & Sutro LLP

[57] ABSTRACT

A damping device includes a plurality of rockets (3) each having a nozzle (4) directed outward and disposed at the four corners on the upper floor of a building structure (1) and a device for sensing an earthquake and operating the rockets. With this arrangement, there can be provided a damping device for a building structure which is applicable not only to new building structures but also to existing building structures and can cope with a sudden exciting force caused by, for example, an earthquake with a vertical shock which has been conventionally impossible to be coped with.

6 Claims, 6 Drawing Sheets

ROCKET DAMPING DEVICE

BACKGROUND OF THE INVENTION

1. Field of the Invention

The present invention relates to an apparatus for reducing an exciting force applied to a building by an earthquake. More specifically, the present invention relates to a damping device for cancelling an exciting force by actively generating a force.

2. Description of the Related Art

Passive seismic isolators (structure) and active damping devices are employed for preventing the collapse of a building structure caused by the exciting force of an earthquake. A passive seismic isolator, is composed of a damping material, such as laminated rubber sheets or the like interposed between a building structure and the earth surface to prevent the horizontal exciting force resulting from an earthquake from being directly applied to the building structure. Such a device is simple in construction and excellent in performance. However, since the apparatus must be inserted between the building structure and the foundation (earth surface), it is difficult to apply the apparatus to existing building structures, although it is applicable to new building structures.

An active damping device includes an artificial vibrator installed in a building structure. An acceleration caused by an earthquake is sensed by a sensor, the direction in which the building structure is vibrated is calculated by a computer and an exciting force in the direction for cancelling the vibration of the building structure is generated by the vibrator to thereby reduce the vibration. This apparatus is also applicable to an existing building structure. The vibrator generates the exciting force by swinging a large weight by a motor or rotating an eccentric weight. Thus, the damping device has a problem that a certain period of time is needed before the cancelling exciting force is generated. In particular, since an earthquake called a shallow earthquake causes large vibration without any previous notice, an exciting force is applied to a building structure before the damping device is operated.

An object of the present invention is to provide a damping device applicable to an existing building structure and capable of coping with a sudden exciting force resulting from, for example, an earthquake with a vertical shock.

SUMMARY OF THE INVENTION

According to the present invention, there is provided a rocket damping device for a building structure which comprises a plurality of rockets each having a nozzle directed outward and disposed at an upper floor of the building structure and a device for sensing an earthquake and operating the rockets.

The building structure is, for example, a high-rise building and the rockets are preferably disposed longitudinally in openings formed adjacent to the respective corners of the building in an intermediate portion thereof.

When the building receives an exciting force, it is sensed by a sensor and processed by a computer and the computer transmits an ignition signal to the rockets to jet them to thereby obtain a damping force.

DESCRIPTION OF PREFERRED EMBODIMENTS

A rocket damping device for a building structure according to the present invention will be described in more detail with reference to the drawings.

Figure 1:
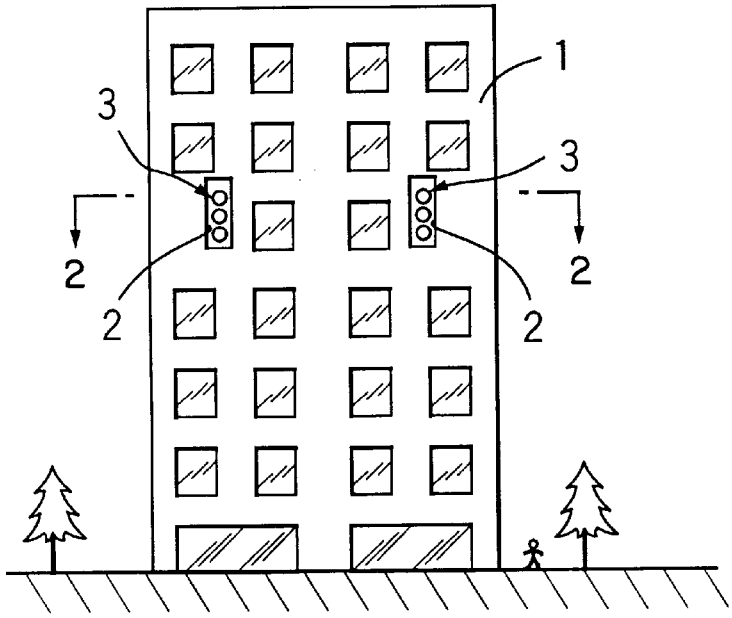
FIG. 1 is a view explaining the external appearance of a building to which a rocket damping device according to the present invention is applied.
Figure 2:
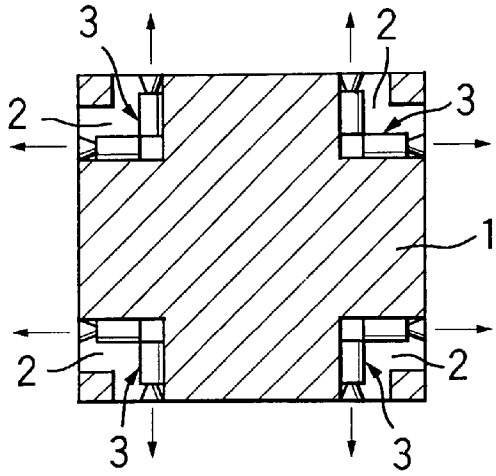
FIG. 2 is a lateral cross sectional view taken along the line 2—2 of FIG. 1.
Figure 3:
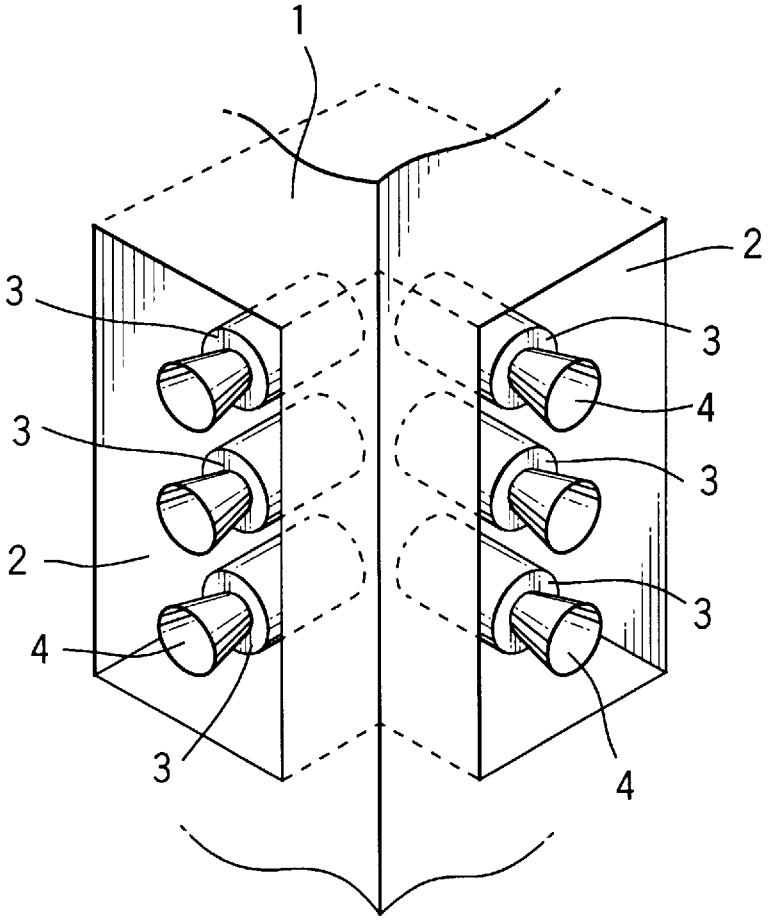
FIG. 3 is a partial perspective view showing the disposition of rockets mounted to the corners of a building.
Figure 4:
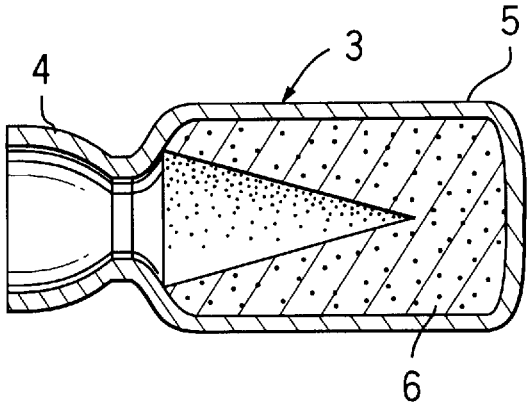
FIG. 4 is a schematic cross sectional view of a solid fuel rocket used in the rocket damping device according to the present invention.

FIG. 1 shows the rocket damping device according to the present invention applied to a building 1 which has openings 2 formed adjacent to the four corners of the building on an intermediate floor thereof and groups of rockets 3 which are disposed in the openings 2. As can be seen from FIG. 2, the rockets 3 are disposed so as to be directed to four directions. More specifically, three sets of the rockets 3 are disposed longitudinally at the respective corners as shown in FIG. 3 so as to be perpendicular to one another with the nozzles 4 thereof directed externally of the building. Each of the rockets is firmly secured to the structural member of the building. In this example of application, a solid fuel rocket is employed as the rocket 3 because it can be easily arranged. As shown in FIG. 4, the solid fuel rocket is composed of a rocket main body 5 provided with the nozzle 4 and a solid fuel 6 loaded in the rocket main body 5. Although it is needless to say that a liquid fuel rocket may be employed in place of the solid fuel rocket, since the liquid fuel rocket is complex in structure and an oxidizing agent is difficult to be managed, it is not suitable to the present invention.

Figure 5:
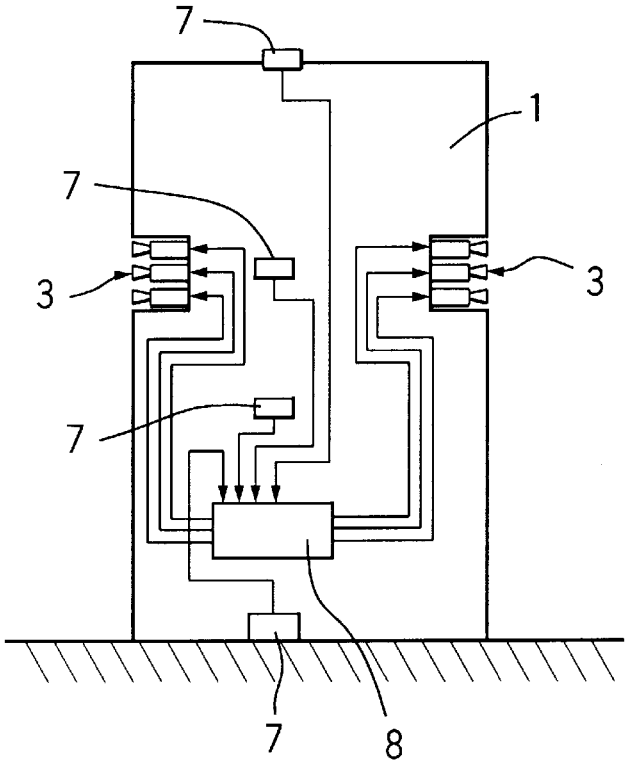
FIG. 5 is an overall schematic view explaining the rocket damping device according to the present invention applied to a building.

FIG. 5 shows the rocket damping device according to the present invention as a whole wherein only vibration in the right and left directions on the figure is taken into consideration for simplification.

An acceleration sensor 7 detects an acceleration caused by the vibration of the earth surface. Accelerator sensors 7 are disposed at every few floors of the building 1 to detect the magnitudes and the directions (right or left) of the accelerations of the respective floors. A computer 8 monitors the signals from the sensors 7 at all times and calculates speeds and dislocations based on the accelerations and then calculates the strain of the building. When the strain exceeds a predetermined value, the computer 8 sends an ignition signal to the rockets 3 which are disposed in the direction for cancelling the strain. At the time, the number of the rockets 3 to be ignited is determined depending upon the magnitudes of the accelerations and the increasing ratio of the strain.

Figure 6:
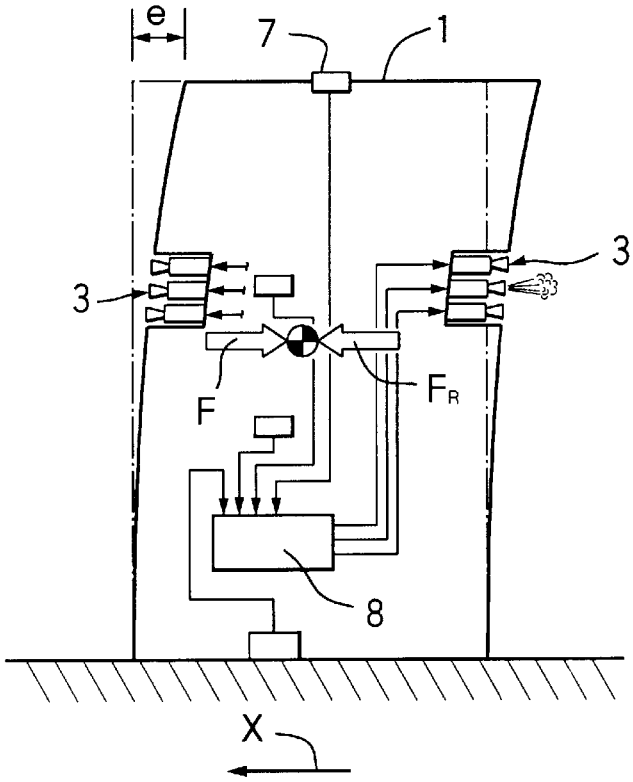
FIG. 6 is a view similar to FIG. 5 showing a state that the rocket is jetted.

FIG. 6 shows the state where the rocket 3 is jetted in the direction for cancelling the deformation of the building 1 which is deformed by the dislocation of the earth surface caused by an earthquake. When it is assumed that a dislocation X is caused in a certain period of time by the earthquake, a reaction force (mass of building multiplied by acceleration resulting from dislocation) F acts on the center of gravity of the building (for the sake of convenience) from the left to the right. When a strain e is caused by the reaction force and the strain e is determined to be larger than a predetermined value, the right rocket 3 is operated to cancel the strain, so that a force $F_R$ is applied to the center of gravity of the building to thereby suppress the increase of the strain. It is contemplated that several milliseconds are necessary for the sensor 7 to detect the acceleration, the computer 8 to calculate the strain and determine whether the rocket is ignited or not and the rocket to be ignited and several tens of milliseconds are necessary for the rocket to start to actually generate a force. On the other hand, since a cycle of the dislocation resulting from an earthquake is about 0.5–1 second, the above conditions are sufficient to suppress the dislocation.

When an exciting force is applied from an oblique direction, the rockets in the X- and Y-directions are simultaneously ignited to cope with the oblique force by a synthesized force. The angle of the synthesized force is changed by changing the number of rockets in the X- and Y-directions.

Figure 7:
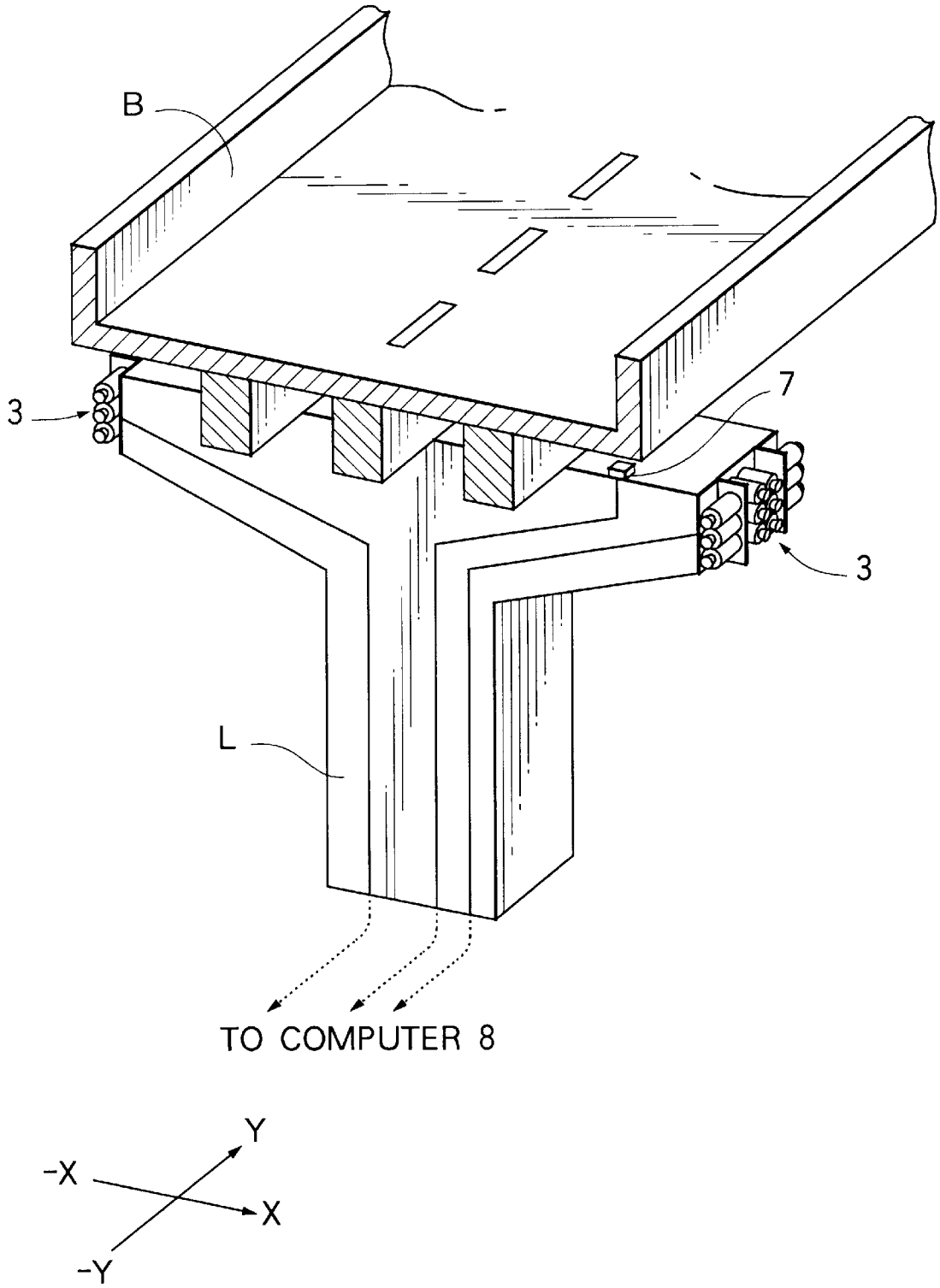
FIG. 7 is a perspective view showing an embodiment in which the rocket damping device according to present invention is applied to a pier.

FIG. 7 is an example in which another embodiment of the present invention is applied to a bridge of a road or the like. Groups of rockets 3 are disposed to the pier L of the bridge B of the road or the like at both ends of the upper portion thereof, and an accelerator sensor 7 is mounted to the right end of the piper L. Each of them is connected to a computer 8 through an ignition signal cable and a sensor signal cable.

Figure 8:
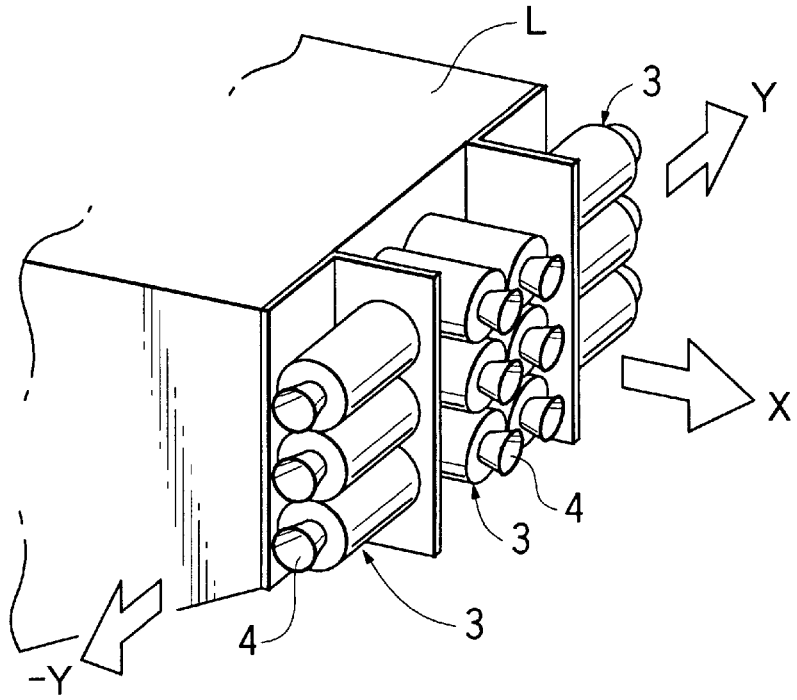
FIG. 8 is a partial view showing a group of rockets in enlargement.

FIG. 8 is an enlarged view of the groups of the rockets and it is apparent that the similar group of the rockets are disposed to an opposite side.

The three rockets are disposed longitudinally in each group and six sets of the rockets are mounted in X, Y, -X, and -Y directions, respectively. With this arrangement, any exciting force in a horizontal direction can be coped with. The accelerator sensors 7 on the pier for detecting the acceleration of an earthquake are mounted to every two or three piers L and the signals from all the sensors are input to the computer 8. Since a bridge is distributed long in a horizontal direction different from a building, it is contemplate that the bridge is differently dislocated depending upon the ground where the piers stand, thus the computer must cope individually with the respective piers by observing how the bridge is dislocated as a whole. Although the two embodiments shown above cope with the horizontal exciting force, a vertical exciting force can be also coped with by disposing the aforesaid rockets in an upward and downward directions and additionally employing an accelerator sensor for vertical vibration.

Figure 9:
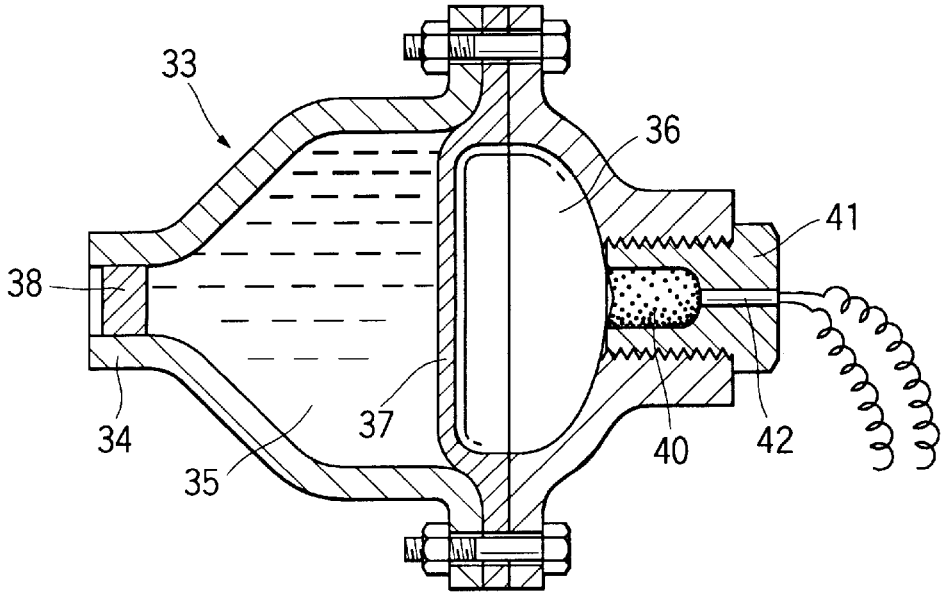
FIG. 9 is a shematic cross sectional view of a water rocket applied to the damping device a according to the present invention.

FIG. 9 shows another example of the rocket of the present invention. The solid fuel rocket used in the invention must jet a high temperature, high pressure gas from its nozzle to obtain a thrust.

Figure 10:
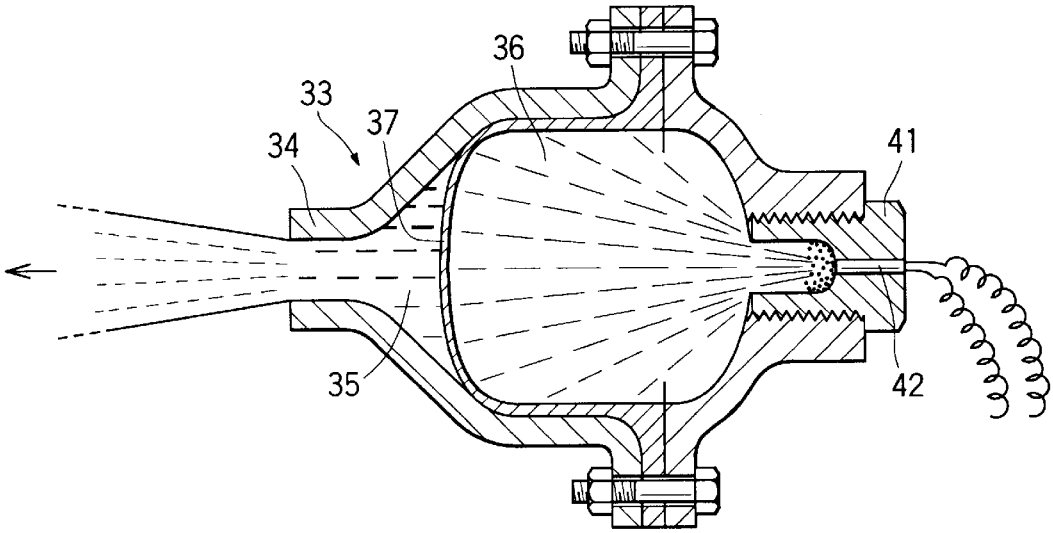
FIG. 10 is a view similar to FIG. 9 showing the state when water in jetted.

Although no problem arises when the rocket is used to the intermediate portion a high-rise building, when it is used at a low position surrounded by other buildings (in particular, by wooden houses) and trees, there is a possibility of a secondary disaster such as a fire caused by the high temperature gas. To solve this problem, there is proposed a water rocket 33 such as the one shown in FIG. 9. The principle of the water rocket 33 itself is known and it is composed of a water chamber 35 communicating with a nozzle 34 and a gas chamber 36, and the former being partitioned from the latter by a partition 37. The water chamber 35 is filled with water and sealed by the stopper 38 fixed to the end of the water chamber 35. The partition 37 is made of a soft and plastically deformable material such as aluminium. When a current flows to the ignition fuse 42 of the water rocket 33, the gunpowder 40 is exploded so that the pressure in the interior of the gas chamber 36 is increased to several hundreds of atmospheric pressures to thereby deform the partition 37 to the left side-as shown in FIG. 10. The stopper 38 of the nozzle 34 of the rocket is blown off by the water in the water chamber 35 and ejected leftward vigorously from the nozzle 34. The thrust of the rocket is represented by $F=m\cdot\mu$, where m is a mass passing through the nozzle per unit time and $\mu$ is a nozzle-passing-through velocity. In the case of an ordinary solid fuel rocket, m has a small value because a gas is used, whereas $\mu$ has a very large value because the gas is supplied from a high temperature, high pressure fuel chamber, thus F also has a very large value. On the other hand, when the same thrust is to be obtained by the water rocket, m has a very large value because the liquid is used, by which the slow value of $\mu$ is compensated for. Further, since the water rocket is simple in construction, it can be made at a low cost. The water rocket can be reused by the replacement of the cartridge and the partition and the supply of water. Consequently, it is contemplated that the rocket damping device is most suitable for building structure.

The damping device according to the present invention has an advantage that it can be readily applied not only to new building but also to existing building and moreover cope with a sudden exciting force resulting from, for example, an earthquake with a vertical shock.

What is claimed is:

1. A combination of a damping device and a building structure, said combination comprising:

a plurality of rockets, each having a nozzle directed outwardly from an upper floor of said building structure; and a rocket operating device for sensing an earthquake and operating said rockets to generate a reaction force applied to said building in response to signals from said rocket operating device to counteract earthquake forces applied to said building, wherein each of said rockets comprises:

a water chamber communicating with said nozzle;

a gas chamber; and a partition separating said water chamber from said gas chamber, said water chamber containing a volume of water and said gas chamber having a combustible fuel disposed therein, whereby said partition is constructed and arranged to expand into said water chamber due to combustion of the combustible fuel in said gas chamber to force the water from said water chamber and through said nozzle at high pressure.

2. The combination of claim 1, wherein said rockets are disposed longitudinally in openings formed adjacent to respective corners of said building structure.

3. The combination of claim 1, wherein said rocket operating device includes an accelerator sensor disposed in said building for sensing an exciting force of an earthquake and a computer for processing a signal from said sensor and transmitting an ignition signal to one or more of said rockets oriented in a direction for canceling strain of said building.

4. A damping system for a building structure, said system comprising:

a plurality of rockets, each having a nozzle to be directed outwardly from an upper floor of the building structure; and a rocket operating device for sensing an earthquake and operating said rockets to generate a reaction force applied to the building in response to signals from said rocket operating device to counteract earthquake forces applied to the building, wherein each of said rockets comprises:

a water chamber communicating with said nozzle;

a gas chamber; and a partition separating said water chamber from said gas chamber, said water chamber containing a volume of water and said gas chamber having a combustible fuel disposed therein, whereby said partition is constructed and arranged to expand into said water chamber due to combustion of the combustible fuel in said gas chamber to force the water from said water chamber and through said nozzle at high pressure.

5. The damping system of claim 4, wherein said rockets are adapted to be disposed longitudinally in openings formed adjacent to respective corners of the building structure.

6. The damping system of claim 4, wherein said rocket operating device includes an accelerator sensor adapted to be disposed in the building for sensing an exciting force of an earthquake and a computer for processing a signal from said sensor and transmitting an ignition signal to one or more of said rockets oriented in a direction for canceling strain of the building.

* * * * *